US009260173B2

(12) United States Patent
Case

(10) Patent No.: US 9,260,173 B2
(45) Date of Patent: Feb. 16, 2016

(54) SHALLOW-DRAFT WATERCRAFT PROPULSION AND STEERING APPARATUS

(71) Applicant: Robert Case, East Rochester, NY (US)

(72) Inventor: Robert Case, East Rochester, NY (US)

( * ) Notice: Subject to any disclaimer, the term of this patent is extended or adjusted under 35 U.S.C. 154(b) by 0 days.

(21) Appl. No.: 14/498,299

(22) Filed: Sep. 26, 2014

(65) Prior Publication Data

US 2015/0050846 A1 Feb. 19, 2015

Related U.S. Application Data

(63) Continuation-in-part of application No. 14/182,902, filed on Feb. 18, 2014, now Pat. No. 8,894,453, which is a continuation-in-part of application No. PCT/US2013/061830, filed on Sep. 26, 2013.

(60) Provisional application No. 61/705,894, filed on Sep. 26, 2012, provisional application No. 61/793,925, filed on Mar. 15, 2013, provisional application No. 61/882,949, filed on Sep. 26, 2013.

(51) Int. Cl.

| | |
|---|---|
| ***B63B 35/71*** | (2006.01) |
| ***B63H 21/17*** | (2006.01) |
| ***B63H 23/02*** | (2006.01) |
| ***B63H 23/04*** | (2006.01) |
| ***B63H 11/04*** | (2006.01) |
| ***B63H 5/16*** | (2006.01) |
| ***B63H 25/42*** | (2006.01) |

(Continued)

(52) U.S. Cl.

CPC ..... *B63H 21/17* (2013.01); *B63B 35/71* (2013.01); *B63H 5/16* (2013.01); *B63H 11/04* (2013.01); *B63H 11/107* (2013.01); *B63H 23/02* (2013.01); *B63H 23/04* (2013.01); *B63H 25/42* (2013.01); *B63H 2005/1256* (2013.01)

(58) Field of Classification Search

USPC ..... 440/6; 114/347
IPC ..... B63H 20/04,21/17; B63B 35/71, 2035/715
See application file for complete search history.

(56) References Cited

U.S. PATENT DOCUMENTS

| | | | |
|---|---|---|---|
| 3,587,512 | A | 6/1971 | Patterson |
| 3,685,481 | A | 8/1972 | Mansell |

(Continued)

FOREIGN PATENT DOCUMENTS

| | | | |
|---|---|---|---|
| DE | 202008011699 | U1 | 11/2008 |
| EP | 1512623 | A2 | 3/2005 |

(Continued)

OTHER PUBLICATIONS

U.S. Patent and Trademark Office (ISA/US), International Search Report and Written Opinion of the ISA as from PCT/US2014/057765 as completed on Dec. 10, 2014 (12 pgs.).

(Continued)

*Primary Examiner* — Stephen Avila
(74) *Attorney, Agent, or Firm* — Barclay Damon, LLP

(57) ABSTRACT

A watercraft includes a stern flotation compartment. The hull is carved out underneath the gunwales to admit a vertical cylindrical sleeve extending through the flotation compartment from top to bottom, and sealed top and bottom. A studded vertical mounting tube carrying an electric motor fits within a slotted cylindrical steering tube; the latter is carried on rotatable bearings affixed to the vertical cylindrical sleeve. A steering assembly is affixed to the slotted cylindrical steering tube and a guide tube fits closely within the vertical mounting tube. An electrical power cable is connected to the electric motor and a retraction assembly is affixed to the electric motor.

19 Claims, 16 Drawing Sheets

(51) Int. Cl.
*B63H 11/107* (2006.01)
*B63H 5/125* (2006.01)

(56) References Cited

U.S. PATENT DOCUMENTS

| | | | |
|---|---|---|---|
| 4,226,206 | A | 10/1980 | Wilson |
| 4,406,630 | A | 9/1983 | Wood, Jr. |
| 4,734,066 | A | 3/1988 | Burgess |
| 5,125,858 | A | 6/1992 | Salvetti |
| 6,431,923 | B1 | 8/2002 | Knight et al. |
| 6,478,639 | B1 | 11/2002 | Covell, III |
| 2004/0255836 | A1 | 12/2004 | Hopkins |

FOREIGN PATENT DOCUMENTS

| | | | |
|---|---|---|---|
| EP | 1876094 | A2 | 1/2008 |
| NL | 1000019 | C1 | 10/1996 |
| WO | WO8903341 | A1 | 4/1989 |
| WO | WO2005108275 | A1 | 11/2005 |
| WO | WO2008134762 | A1 | 11/2008 |

OTHER PUBLICATIONS

ISA/EP, Written Opinion of the ISA and International Search Report of PCT International Application No. PCT/US2013/061830 (Int'l. Filing date: Sep. 26, 2013), as completed Jan. 17, 2014 and mailed Jan. 24, 2014 (11 pgs.).

SHALLOW-DRAFT WATERCRAFT PROPULSION AND STEERING APPARATUS

CROSS-REFERENCE TO RELATED APPLICATIONS

This application is a continuation-in-part of U.S. application Ser. No. 14/182,902 (filed Feb. 18, 2014—now U.S. Pat. No. 8,894,453), which is a continuation-in-part of International Application Serial No. PCT/US2013/061830 (filed Sep. 26, 2013) which claims priority to U.S. Provisional Application Serial Nos. 61/705,894 (filed Sep. 26, 2012) and 61/793,925 (filed Mar. 15, 2013). U.S. application Ser. No. 14/182,902 is a non-provisional application of, and claims priority to, U.S. Provisional Application Ser. No. 61/882,949 (filed Sep. 26, 2013), the entirety of each noted document being incorporated herein by reference.

TECHNICAL FIELD

This disclosure relates to propulsion and steering systems for watercraft, and more specifically to retractable electric-motor mountings and hull modifications providing for steering of light watercraft such as canoes.

BACKGROUND

Canoes, pirogues, skiffs, dinghies, and similar shallow-draft boats are often used by fishermen or recreational boaters to paddle easily through reaches of shallow water that may be too narrow for rowing or that may be clogged to varying degrees by vegetation and debris. To reduce effort and speed their rate of travel, many boaters attach outboard electric trolling motors to their craft. Electric trolling motors are lightweight, efficient, and virtually silent, and derive their power from batteries or other sources of electric power carried in the boat.

Efficiency of the motor's operation is a critical factor in the utility of such electric motors, since batteries are heavy, and since other sources of electricity such as solar panels are dependent on the intensity of the light they receive. The more efficient the motor, the greater the time the boat may be operated away from its sources of charging. The greater the time between charges, the greater is the range of the boat's possible travel.

Most electric trolling motors are contained in a waterproof cylindrical housing, and drive a propeller at the aft end of the housing. The propeller is used to push the motor and thus the boat through the water. For the electric trolling motor to operate most efficiently, it must be immersed in the water so that its propeller blades are also fully immersed in the water where the flow of water is least disrupted by the boat hull or other parts of the boat that lie directly ahead of the motor and propeller. Although this problem is of less concern with canoe hulls, it is more important in other less-streamlined hull designs. Mounting the motor in the undisrupted water flow confronts a second problem: the presence of debris or vegetation in the path of the boat. Often the motor or propeller can become fouled in plants or lines, or can be damaged by striking hard objects that pass beneath the boat's hull as it moves.

For those boats having a flat stern panel, such as square-stern rowboats or skiffs, the outboard trolling motor is customarily clamped or otherwise mounted to the flat stern piece at the longitudinal centerline or keel line of the boat. For those boats having a pointed stern, such as canoes or pirogues, the outboard trolling motor is customarily clamped or mounted to an external part of a stern crosspiece on one side or the other of the boat. Such mountings place the motor on the side of the pointed stern.

The mounting of a motor on one side of the boat stern introduces a problem with steering. Since the motor is on one side, its thrust along the longitudinal axis of the boat will tend to turn the boat toward the other side. Consequently the tendency to turn the boat must be countered by adjusting the motor orientation, the boat's rudder, or any other steering device used. Such adjustments must vary according to the motor speed and thrust, the wind, and other factors affecting the course of the boat.

From the above observations, there is an evident need for a propulsion system that retains the efficiency, quiet, speed, and other desirable characteristics of the conventional art, while protecting the motor, propeller and mountings from submerged obstacles and debris, and eliminating problems associated with mounting the motor on the side of the boat.

DETAILED DESCRIPTION

Figure 1:
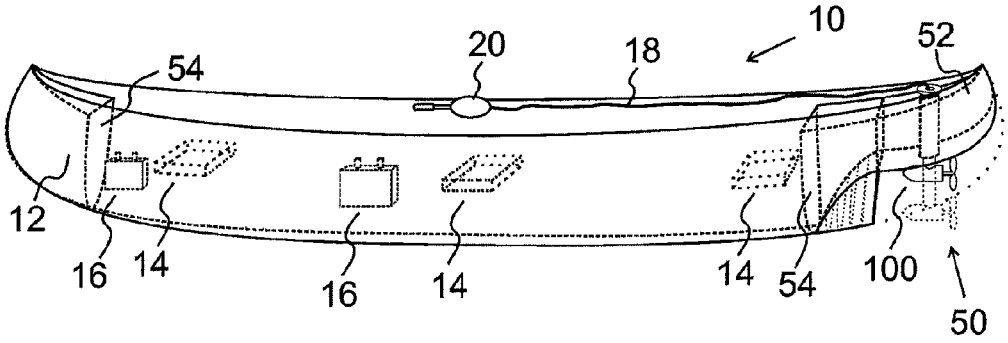
FIG. 1 shows a canoe incorporating hull and motor-related modifications.

The accompanying paper, entitled "Various Embodiments" and extending for a total of seven pages (hereinafter, the "Paper" or "Papers"), is fully part of this provisional patent application and is incorporated herein by reference. References in this paper to the "disclosure," and use of the term "herein," refer to this paper and to the Papers unless otherwise specified. The term "drawings" used herein refers to drawings attached herewith and to sketches, drawings, illustrations, photographs, or other visual representations found in the Papers. The terms "I," "we," "our" and the like throughout the Papers do not refer to any specific individual or group of individuals.

One embodiment herein provides a redesigned hull stern, propulsion system, and steering system for a canoe or other light watercraft. The craft's hull contour shows a stern carved out underneath the gunwales to admit a vertical motor shaft mount while streamlining water flow during travel. The vertical motor shaft extends through the craft's stern flotation compartment from above the compartment's top down to an electric motor below the waterline. The vertical motor shaft retracts in shallow water and provides for lateral steering of the motor.

According to various aspects, there is provided a watercraft, comprising:

a) gunwales;
b) a stern flotation compartment;
c) a hull having a modified stern hull contour carved out underneath the gunwales to admit a vertical cylindrical sleeve;
d) the vertical cylindrical sleeve extending through the stern flotation compartment from the compartment's top down to the bottom of the modified stern hull contour and sealed to the compartment's top and sealed to the bottom of the modified stern hull contour;
e) a slotted cylindrical steering tube having one or more vertical slots open through its sides;
f) a steering assembly affixed to the slotted cylindrical steering tube;
g) a vertical mounting tube fitting closely within the slotted cylindrical steering tube;
h) one or more studs anchored to an exterior of the vertical mounting tube, each protruding through one of the one or more vertical slots in the slotted cylindrical steering tube;
i) a guide tube fitting closely within the vertical mounting tube;
j) an electric motor attached to a bottom end of the vertical mounting tube;
k) an electrical power cable connected to the electric motor;
l) a retraction assembly affixed to the electric motor; and
m) an upper bearing and a lower bearing both affixed to the vertical cylindrical sleeve and the slotted cylindrical steering tube so as to allow free rotation of the cylindrical steering tube around its longitudinal axis.

According to various aspects, there is provided a watercraft, comprising:

a) a stern flotation compartment;
b) a hull having a modified stern hull contour carved out underneath the gunwales;
c) a vertical cylindrical sleeve extending through the stern flotation compartment from the compartment's top down to the bottom of the modified stern hull contour and sealed to the compartment's top and sealed to the bottom of the modified stern hull contour;
d) a retractable shaft and a steering tube adapted to permit the retractable shaft to rotate, the retractable shaft and the steering tube arranged within the vertical cylindrical sleeve;
e) an electric motor attached to the bottom end of the retractable shaft; and
f) an upper bearing and a lower bearing both affixed to the vertical cylindrical sleeve so as to allow free rotation of the cylindrical steering tube around its longitudinal axis.

The above paragraphs are intended only to provide a brief overview of subject matter disclosed herein according to one or more illustrative embodiments, and do not serve as a guide to interpreting the claims or to define or limit the scope of the invention. The claimed subject matter is not limited to implementations that solve any or all disadvantages noted in the background.

Figure 2:
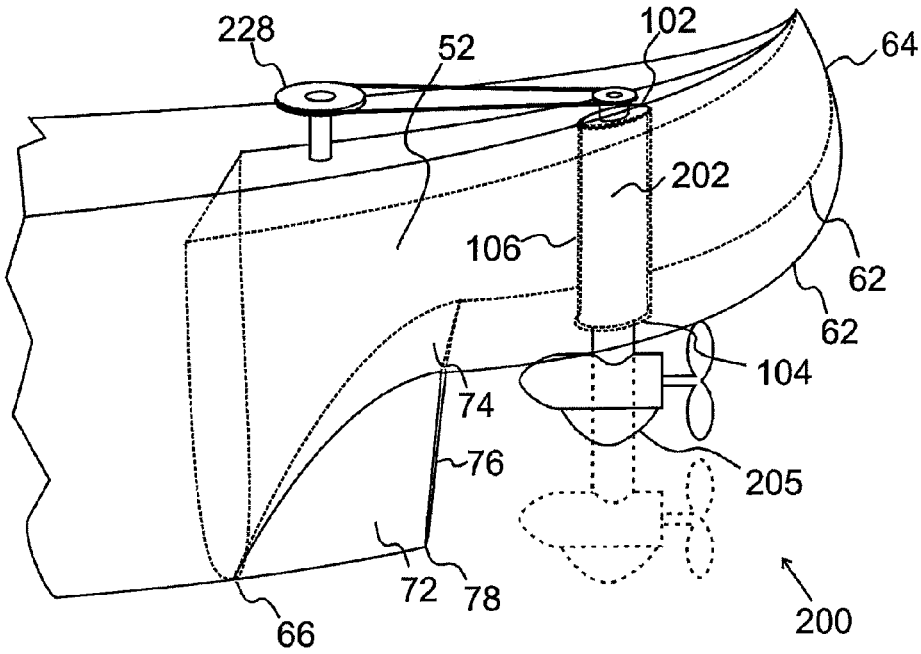
FIG. 2 provides a closer view of a craft's hull and motor-related modifications, showing greater detail.

Referring to FIGS. 1 and 2, a depicted watercraft, e.g., a canoe, has hull 10 pointed at both ends, with a flotation compartment 12, 52 at bow and stern respectively, and two or three flat seats 14 on which a canoeist can face forward. Flotation compartment 12 and flat seats 14 are features of conventional canoes.

FIGS. 1 and 2 show the exemplary craft's hull modifications 50. Each flotation compartment 12, 52 is sealed off from the rest of the canoe by a bulkhead 54, and may be fashioned from flotation foams made from urethane or PVC. Such flotation foam inserts are required for fiberglass hulls to prevent the craft from sinking if the hull is breached. Other options include sealed flotation compartments filled with air, lightweight plastic foam such as foamed polystyrene, air-containing objects such as table-tennis balls, or other substances and structures providing buoyancy. A canoe may or may not have a full-length keel.

In embodiments using conventional electric power, batteries 16 are mounted in the watercraft for connection to cable 18 to supply power to the motor.

The embodiment of craft has a hull modified to accept an electric motor. The craft may be fabricated initially to accept the electric motor or an existing craft may have its hull modified to accept an electric motor. The exemplary craft's hull modifications are most clearly shown in FIG. 2. In a custom-built embodiment, the hull is cut along two contours 62 extending from at or near the topmost stern point 64 in a rough 'S' path as shown, down to where the cuts meet a the keel or centerline 66. The hull's integrity is restored by installing panels 72, 74, and 76, restoring any buoyancy materials, and sealing the seams of panels 72, 74, and 76 to the cut hull.

Panels 72, 74, and 76 are shaped so as to smooth the flow of water past the hull during normal forward travel, narrowing from the conventional hull contour at 66 to a point 78 at the bottom flaring to full hull width at their top. The reshaped keel or centerline at the stern helps straighten and stabilize the course of the watercraft.

Various embodiments described herein may be installed in hulls of watercraft other than canoes, with hull modification appropriate to each hull type.

Two round openings 102 and 104 are drilled one above the other to admit the vertical motor shaft 202 of the craft's propulsion and steering systems, and a sleeve 106 is inserted vertically into the resulting openings and sealed to the hull at both openings 102 and 104 to restore hull integrity again.

In a hull-fabrication embodiment, the craft's hull modifications are subsumed in the design of the hull, after which the hull is vacuum-formed in a single step according to the craft's designed structure. The vacuum-formed hull may or may not incorporate sleeve 106. Buoyancy compartment 52 is formed separately, incorporating opening 102, and sealed to the hull and sleeve 106 as is done in the custom-built embodiment.

In both hull embodiments, the craft's propulsion and steering system 200 is installed and secured in sleeve 106 using any of a range of conventional fittings, longitudinal serrations, adhesives, sealants, and attachment hardware. The installed propulsion and steering system 200 is then connected to motor controls, steering controls, and retraction controls as described hereinbelow.

Figure 3:
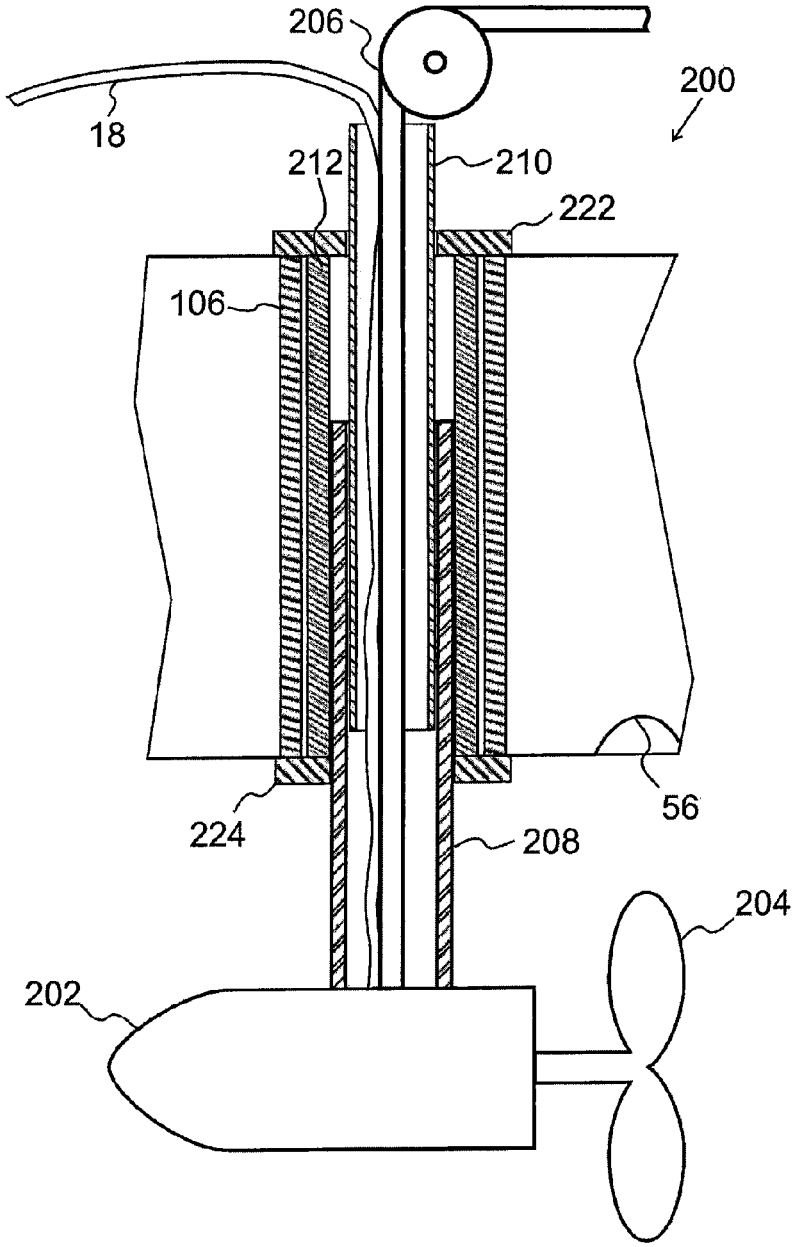
FIG. 3 is a cutaway view of mountings for a motor.
Figure 4:
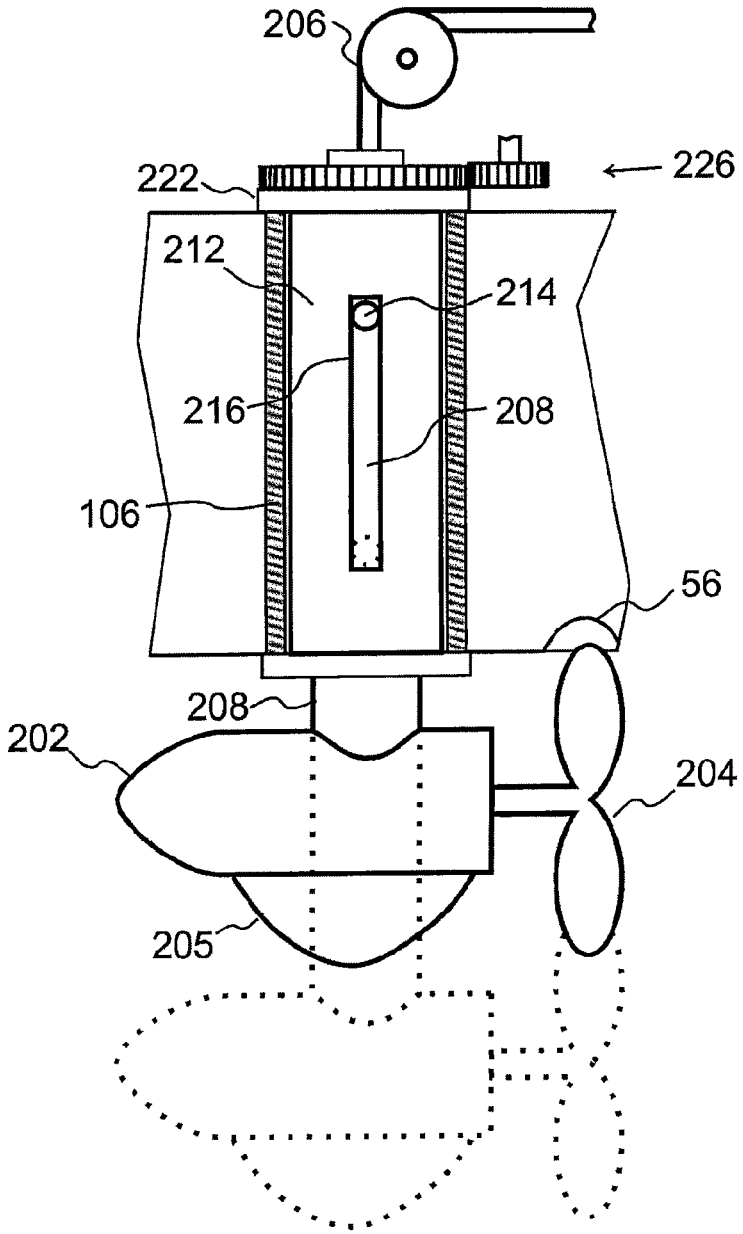
FIG. 4 shows a craft's retraction and steering structures in partial cutaway.

FIGS. 3 and 4 show construction and design of an exemplary craft's propulsion and steering system. As shown in FIG. 3 in a cutaway view, motor 202 with propeller 204 is attached to a vertical retraction arm or cable 206. In a mounting-tube enclosed embodiment, vertical retraction arm or cable 206 and electrical power line 18 are then threaded through vertical mounting tube 208. The result is that the control of power and retraction of motor 202 and propeller 204 may then be accomplished remotely.

Vertical mounting tube 208 is then fitted around guide tube 210, and tubes 208 and 210 are in turn fitted into slotted steering tube 212 as shown in FIG. 4. Vertical mounting tube 208 is then secured to slotted steering tube 212 by a stud 214 that protrudes outward from vertical mounting tube 208 through slot 216 in slotted steering tube 212 as shown in FIG. 4, thereby preventing vertical mounting tube 208 from rotating independently of slotted steering tube 212 while allowing said tube 212 to move vertically throughout the length of slot 216 to retract or extend the motor's position with respect to the watercraft.

Slotted steering tube 212, vertical mounting tube 208, and guide tube 210 comprise vertical motor shaft 202.

The present embodiment separates its steering and retraction functions as follows. Steering is done by turning the propulsion and steering system 200 of motor 202, vertical mounting tube 208, guide tube 210, and slotted steering tube 212, using gears 226 or (as shown in FIG. 2) a pulley 228. Gears 226 or pulley 228 serve to rotate said entire assembly around its vertical axis within sleeve 106. Bearings 222 and 224 provide both stabilization and ease of rotation of said propulsion and steering system 200. More details of bearing 222 and gears 226 are described hereinbelow.

Retraction is done by applying upward retracting force to motor 202 via vertical retraction arm or cable 206. In a retraction-arm embodiment, extension is performed by applying downward pressure at the top of arm 206 or by allowing gravity to lower motor 202. In a retraction-cable embodiment, extension is performed by releasing tension at the top end of cable 206, letting gravity lower motor 202.

Figure 5:
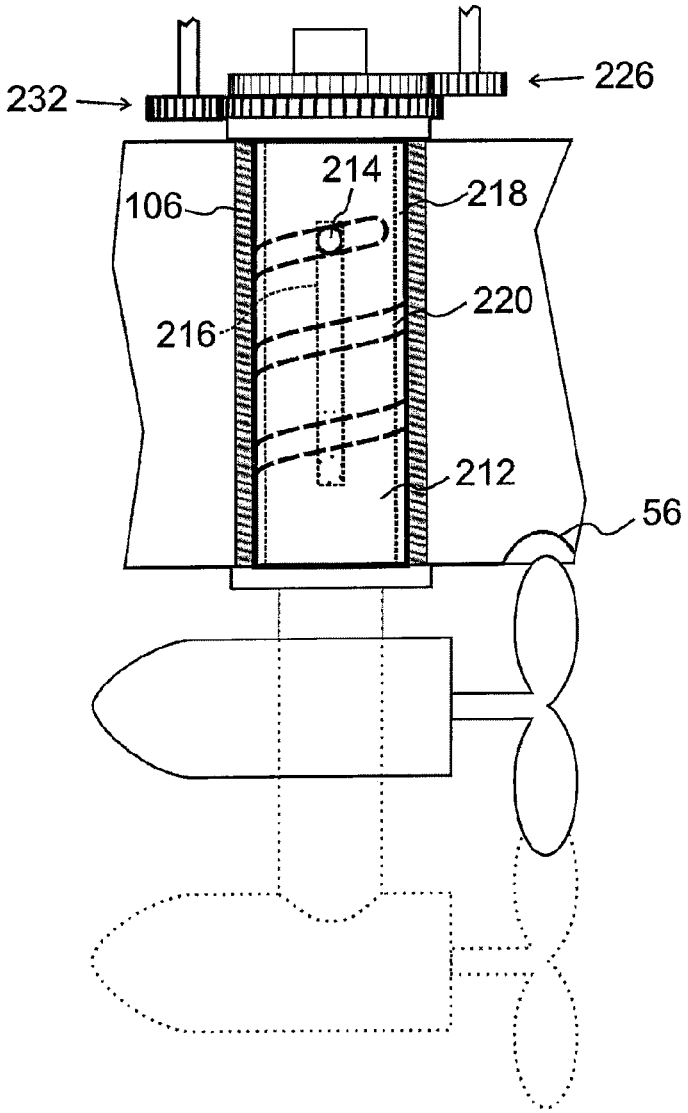
FIG. 5 illustrates a craft's helical retraction-screw embodiment for retraction and extension of the motor, in partial cutaway.

In a retraction-screw embodiment, retraction and extension of motor 202 are performed using an additional rotating sleeve 218 as shown in FIG. 5. Rotating sleeve 218 is fabricated with one or more helical grooves 220 on its inner surface. To incorporate sleeve 218, slotted steering tube 212 in the retraction-screw embodiment is fabricated to provide added space between its outer surface and the inner surface of vertical motor shaft 106, each stud 214 is lengthened so as to protrude into a corresponding helical groove of rotating sleeve 218.

Rotating sleeve 218 is installed concentrically between vertical motor shaft 106 and slotted steering tube 212 so that rotation of sleeve 218 around its vertical axis causes stud 214 to move up or down depending on the direction of rotation. Stud 214 cannot move horizontally due to the restriction imposed by slot 216 of slotted steering tube 212, and therefore the effect is that the entire assembly of motor 202 is retracted or extended as in above-described retraction embodiments.

In said retraction-screw embodiment, retraction and extension are driven by gear system 232, separate from gear system 226 or pulley system 228 used to steer the watercraft.

Figure 6:
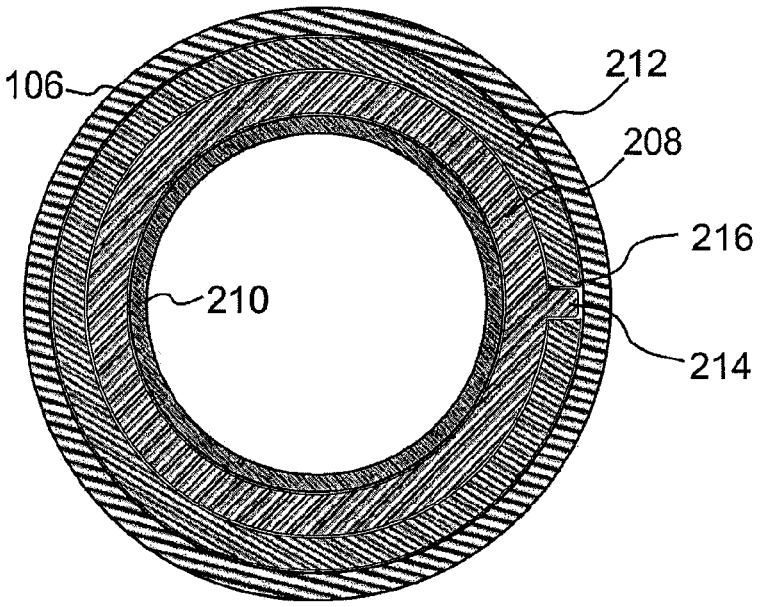
FIG. 6 shows a horizontal cross-section of the vertical tubes, sleeves, and shafts of the propulsion and steering system.
Figure 7:
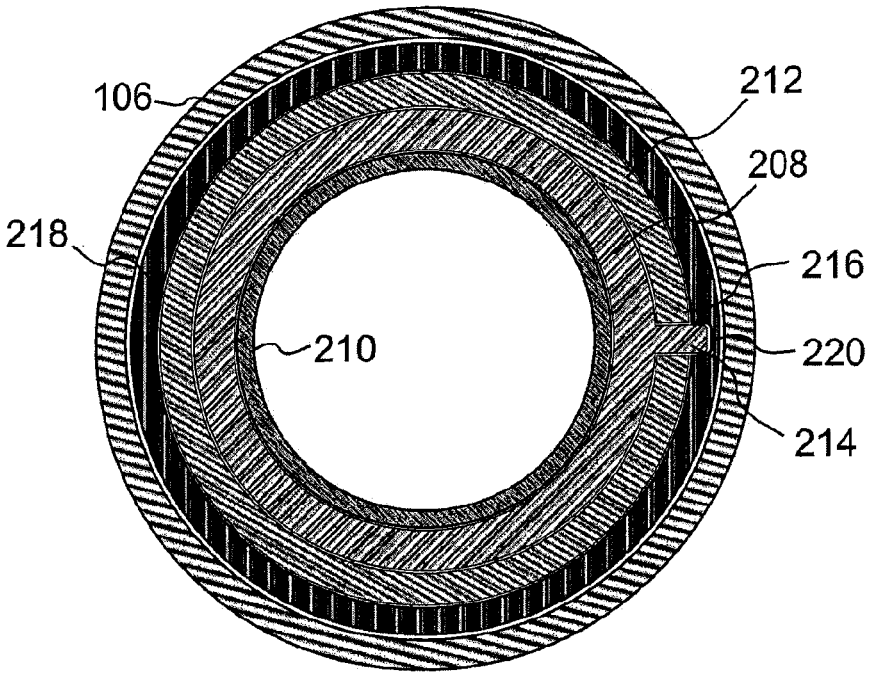
FIG. 7 shows a horizontal cross-section of the vertical tubes, sleeves, and shafts of the propulsion and steering system in a helical retraction-screw embodiment.

For horizontal cross-sections of the vertical tubes, sleeves, and shafts of propulsion and steering system 200 at the level of stud 214, see FIGS. 6 and 7. In order from outermost to innermost for the retraction-cable and retraction-arm embodiments, FIG. 6 shows sleeve 106, slotted steering tube 212, vertical mounting tube 208, and guide tube 210. Stud 214 is also shown protruding from mounting tube 208 into slot 216 in slotted steering tube 212.

Likewise for the retraction-screw embodiment, FIG. 7 shows sleeve 106, rotating sleeve 218, slotted steering tube 212, vertical mounting tube 208, and guide tube 210. Stud 214 is also shown protruding from mounting tube 208 through slot 216 in slotted steering tube 212 into groove 220 in rotating sleeve 218.

Figure 8:
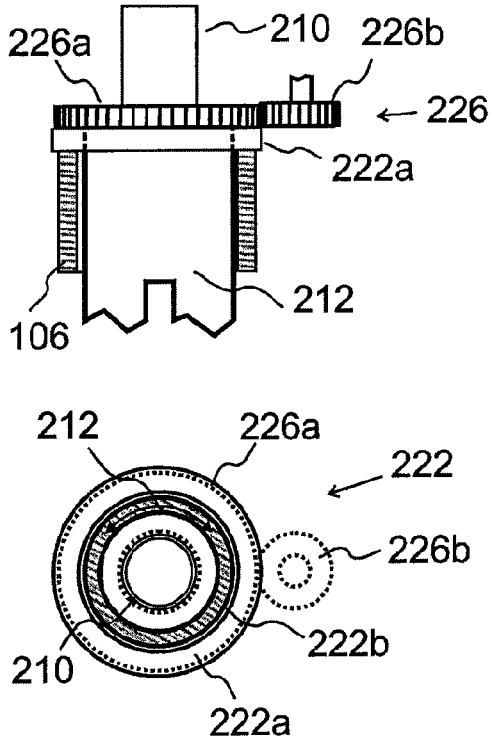
FIG. 8 shows relationships and connections between the sleeve, the upper bearing, the slotted steering tube and steering gears, and the guide tube of the propulsion and steering system, in an exemplary embodiment.

For the relationships and connections between sleeve 106, bearing 222, slotted steering tube 212, gears 226, and guide tube 210, see FIG. 8 showing two views of said components. The fixed portion 222*a* of bearing 222 is anchored to sleeve 106 which is stationary with respect to the boat hull. In a molded hull embodiment, the fixed portion 222*a* of bearing 222 is anchored directly to the hull.

The rotating portion 222*b* of bearing 222 is anchored on its inner surface to the outer surface of slotted steering tube 212.

Direct rotation gear 226*a* of gears 226 is anchored to the top surface of slotted steering tube 212. Driving gear 226*b* of gears 226 meshes with direct rotation gear 226*a*, which provides steering force to propulsion and steering system 200.

The inner opening of gear 226*a* is sized so as to fit snugly to the outer surface of guide tube 210, thereby adding stability to the rotating components of propulsion and steering system 200.

Refer to FIG. 1 to see connection of electrical cable 18 to speed controls 20, and to FIG. 2 to see a pulley connection of slotted steering tube 212 to external pulley 228 for steering.

For embodiments providing improved distribution of steering forces, slotted steering tube 212 has two or more vertical slots 216, each corresponding to a separate stud 214.

For embodiments providing improved range of retraction and extension, vertical mounting tube 208 incorporates telescoping sections, of which the largest at the top serves as vertical mounting tube 208 with stud 214. The sections below telescope inside the largest section.

In FIGS. 3, 4, and 5, recess 56 in the craft's hull allows propeller 204 to be more closely and safely retracted upward.

In FIGS. 2 and 4, fin or vane 205 is attached to the bottom of motor 202 in an embodiment. Vane 205 reduces the probability of damage to propeller 204 in the event of unintentional contact with hard objects or bottom of a body of water. In case of such contacts, vane 205 translates impacts into retraction force to retract the motor and propeller. In order to simplify presentation, vane 205 is not shown in FIGS. 1, 3 and 5.

Fin or vane 205 also contributes to the stabilization of the course of the watercraft, and may be turned when the watercraft is being paddled to offset lateral forces resulting from paddling on one side.

Figure 9:
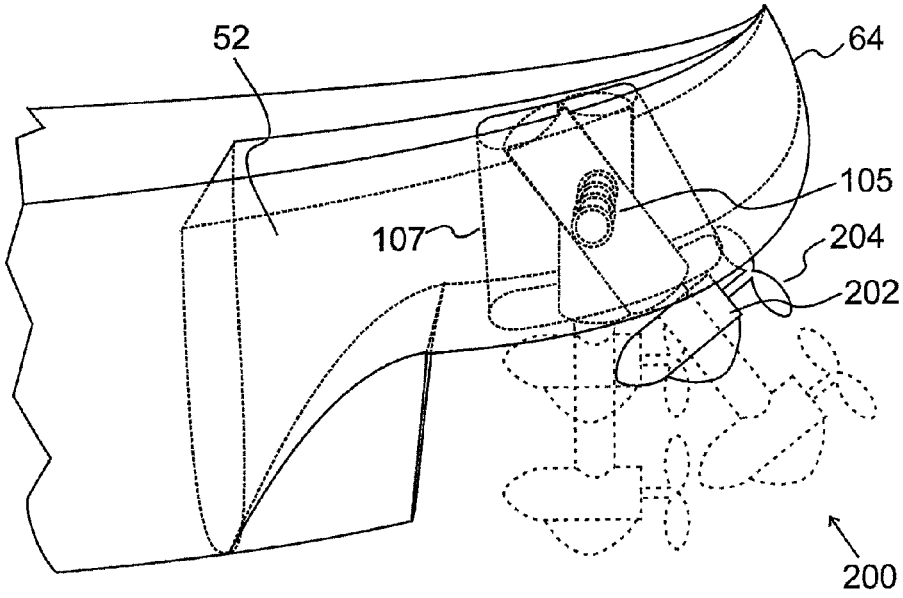
FIG. 9 shows a propulsion and steering system mounted on a lateral pivot.

FIG. 9 shows a propulsion and steering system mounted on a lateral pivot. On watercraft having a geared or integrated steering system mounted atop or around and in a fixed position relative to the propulsion and steering system 200, said steering system and the entire propulsion and steering system 200 described herein can be mounted on a lateral pivot 105 to allow system 200 to rotate in a suitable hull opening 107 either sternward or toward the bow upon encountering obstacles or debris, thereby altering the bodily pitch of motor 202 and propeller 204 as is conventionally provided for outboard motor mounts. Suitable hull opening 107 expands upon and replaces sleeve 106, opening through buoyancy compartment 52 and sealed to the hull at both ends, as shown in FIG. 2.

FIG. 9 shows only sternward rotation, but lengthening of suitable hull opening 107 sternward and providing adequate hull clearance forward of motor 202. The present embodiment provides a low-cost, quiet, lightweight, easy-to-use, long-range propulsion system for users of light watercraft such as canoes, at speeds normally requiring either great manual effort or conventional propulsion systems lacking the craft's advantages.

Figure 10:
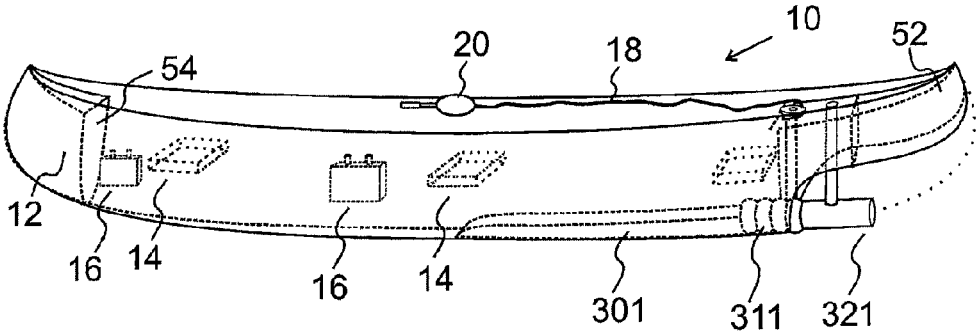
FIGS. 10 and 11 show a flexible-jet jet drive system.

FIG. 10 shows a flexible jet jet drive embodiment having a jet drive 301, a flexible section 311 for redirecting the output jet, and an output jet 321.

Figure 11:
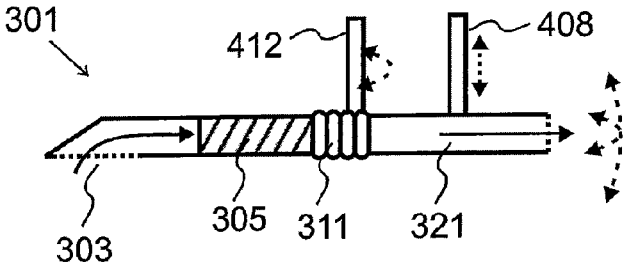

FIG. 11 shows a detailed diagram view of jet drive embodiment 301, with water intake opening 303, electric jet pump drive unit 305, flexible steering and lift passage 311, and movable jet discharge tube 321. FIG. 11 further shows steering shaft and mechanism 412 for lateral redirection of the output jet, and raising and lowering shaft and mechanism 408 for vertical redirection of the output jet.

Figure 12:
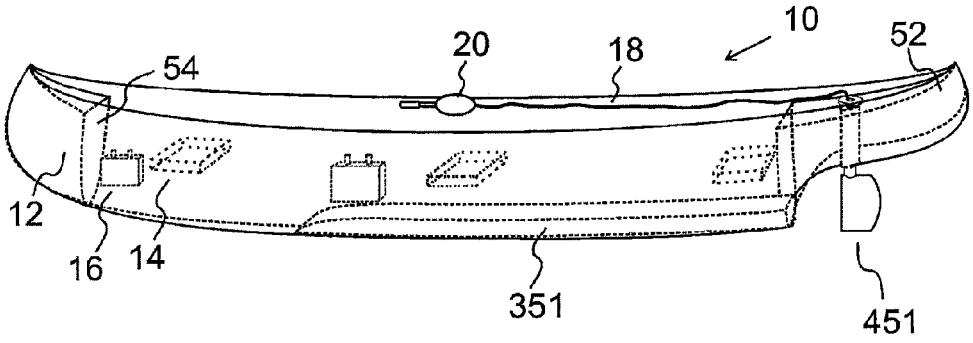
FIG. 12 shows a fixed jet jet drive system.

FIG. 12 shows a fixed jet jet drive embodiment having a jet drive 351 (FIG. 13) similar to the jet pump drive unit 305 and flexible section 311 shown in FIG. 10. The flexible section 311 redirects the output jet, and an output jet 321. FIG. 12 further shows rudder 451 for lateral redirection of the output jet.

Figure 13:
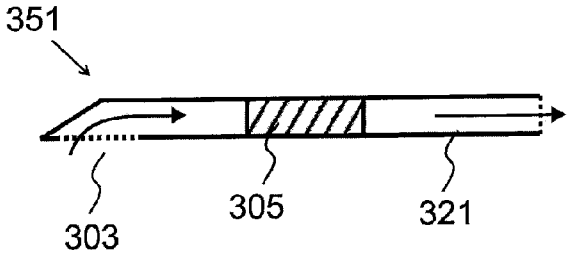
FIG. 13 shows a diagram of a jet drive.

FIG. 13 shows a detailed diagram view of jet drive embodiment 351, with water intake opening 303, electric jet pump drive unit 305, and movable jet discharge tube 321. In an additional feature of embodiment 351, horizontal vanes may be incorporated on rudder 451, and in combination with the tilting feature shown in FIG. 9, may serve to redirect the output jet upward or downward.

Figure 14:
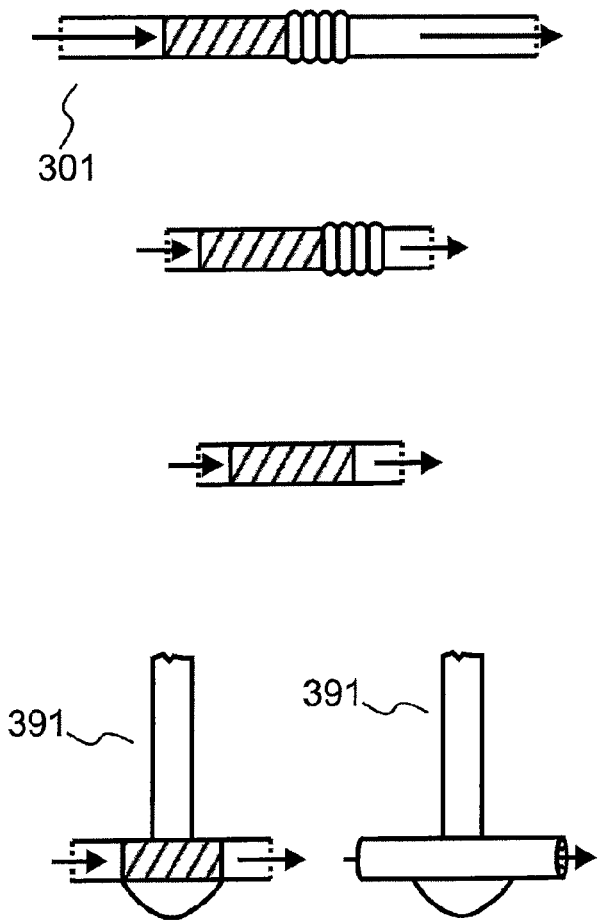
FIG. 14 shows various embodiments of compact jet drives.

FIG. 14 shows a compact jet drive embodiment developed through four stages of design change from jet drive 301 producing a more compact jet drive 391. Compact jet drive 391 may be substituted in all embodiments having electric motor 202 and propeller 204 for said electric motor and propeller, thereby combining the advantages of the jet drive with the steering and raising and lowering features of said embodiments.

Figure 15:
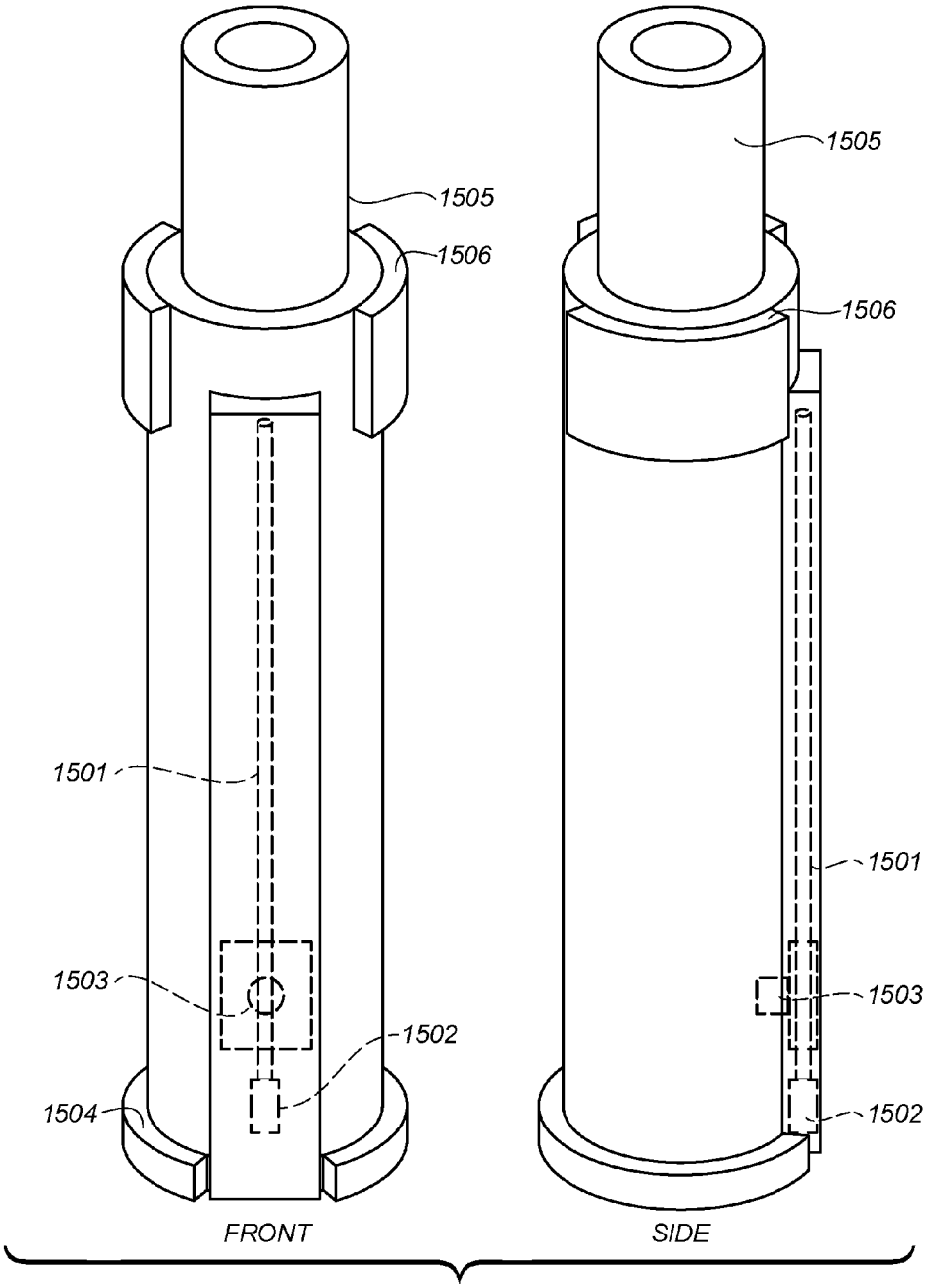
FIG. 15 shows a mechanism for automatically or electronically raising and lowering the motor assembly.

Further embodiments of the drive and steering mechanism are shown in FIGS. 15 to 19 and include ways for electronically controlling raising and lowering the drive mechanism and steering the low draft boat by turning the direction of the propulsion means. FIG. 15 shows the front and sides views of a screw 1501 and motor 1502 assembly on the side of the steering shaft to raise and lower the drive motor. This embodiment uses a unit having a motor, a long helical screw and a slideable attachment piece 1503 that when the screw turns will travel up and down on when receiving a control signal. Copper contacts 1504 can be used to supply power to the outer hull tube. The steering shaft or tube 1505 is shaped so to allow it to travel smoothly in the outer hull tube 1506. This embodiment allows the electronic control of up and down movement of the propulsion means and would allow the control of propulsion depth to be controlled electronically. It is also envisioned that propulsion depth could be controlled via interface with sonar depth finding means that are often used in fishing applications.

As shown on the shaft, element 1503 can ride on the screw moving stud. The screw drive can raise and lower the stud, as described herein.

Figure 16:
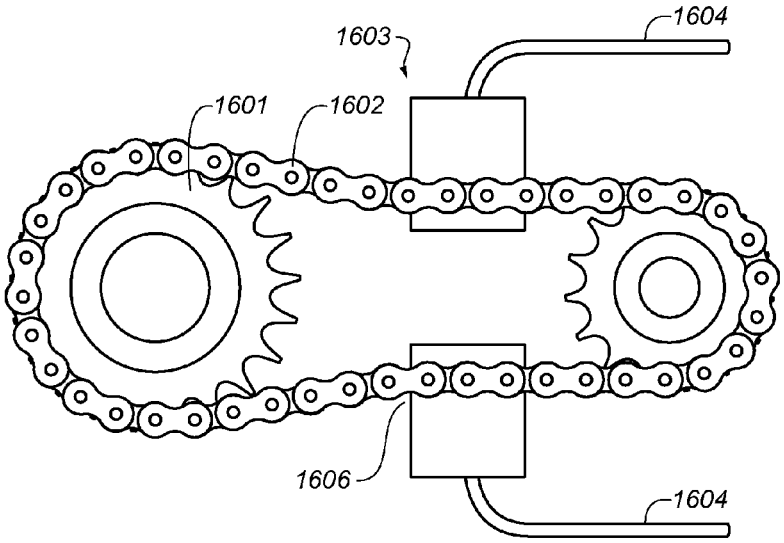
FIG. 16 shows a chain and sprocket steering system.

FIG. 16 describes an embodiment where the steering is controlled by a mechanism including a sprocket 1601 and chain 1602 system 1603 by which cables 1604 are attached to the steering control system 1605 (not shown). The cable can attach to the chain at junction 1606. A sprocket and chain system slows for cable to travel a defined distance allowing for less required initial movement. Sprockets and chains can also reduce play or slack in the steering. A feedback system can be used to determine the initial sprocket position and allows for more accurate control of steering movements.

Figure 17:
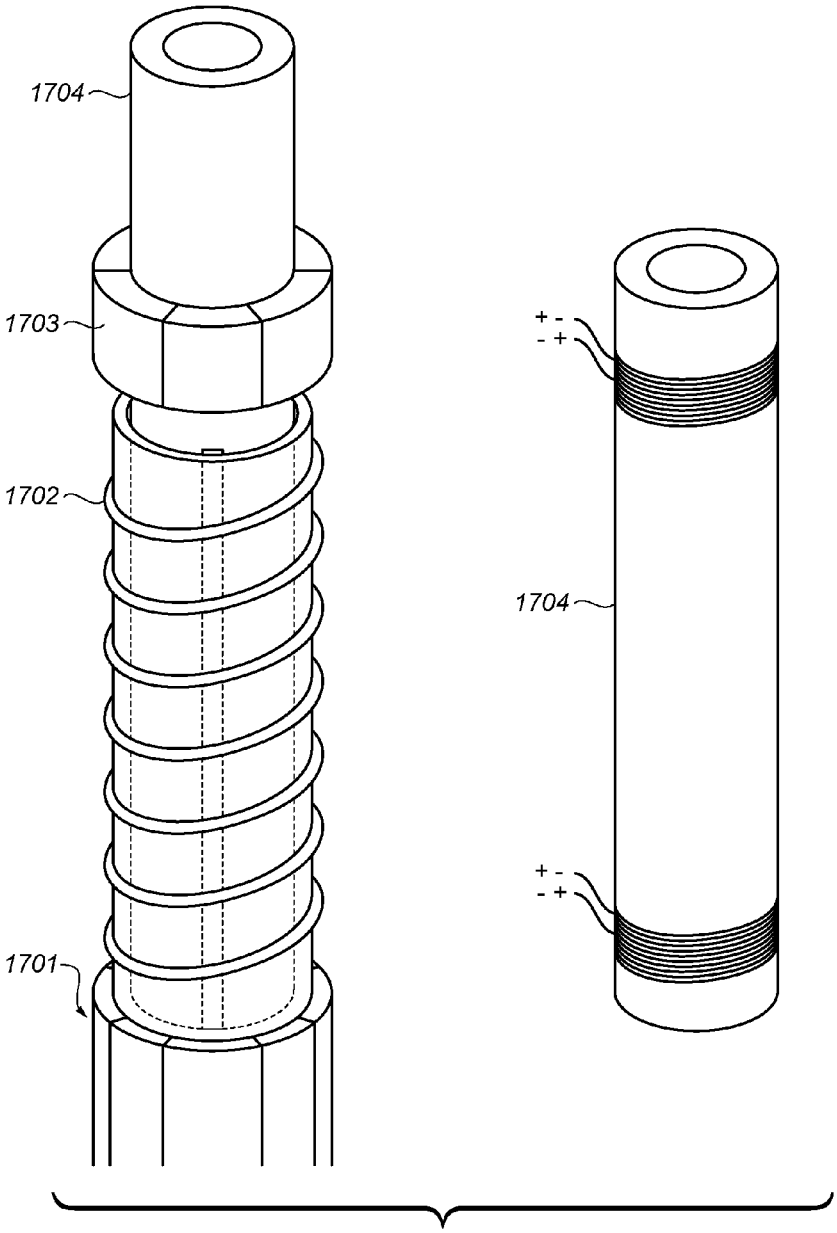
FIG. 17 shows an embodiment of a field generator based steering mechanism.

FIG. 17 describes a hybrid generator/steering mechanism where a steering field generator 1701 can be integrated or included within the confines of the outer hull tube by installing coils 1702 in the outer hull tube. Magnets 1703 are attached to the steering shaft 1704 and the generator operates to provide a useful current when either the unit steers or is moved up/down in the outer hull tube.

Installation of the induction coils can take several forms. For instance they may be installed in the outer hull tube: coils on one area of the tube, e.g., the top, for steering. Coils on another area of the tube, e.g., bottom, for up and down. One coil can turn the shaft for steering; another coil can turn the helical groove for relative motion up/down. Coil and magnetic-field orientations can be selected to provide a desired direction of motion for a given direction of current through the coils. Magnets cab attached to helical coil for generation of electricity during up and down displacement of the propulsion means.

"+" and "−" labels indicate that current can flow through the coils in either direction, as desired. Current can be AC or DC. The coils can be commutated with brushes or brushlessly. One or more phases of AC can be used. Rare earth magnets can be used.

Figure 18:
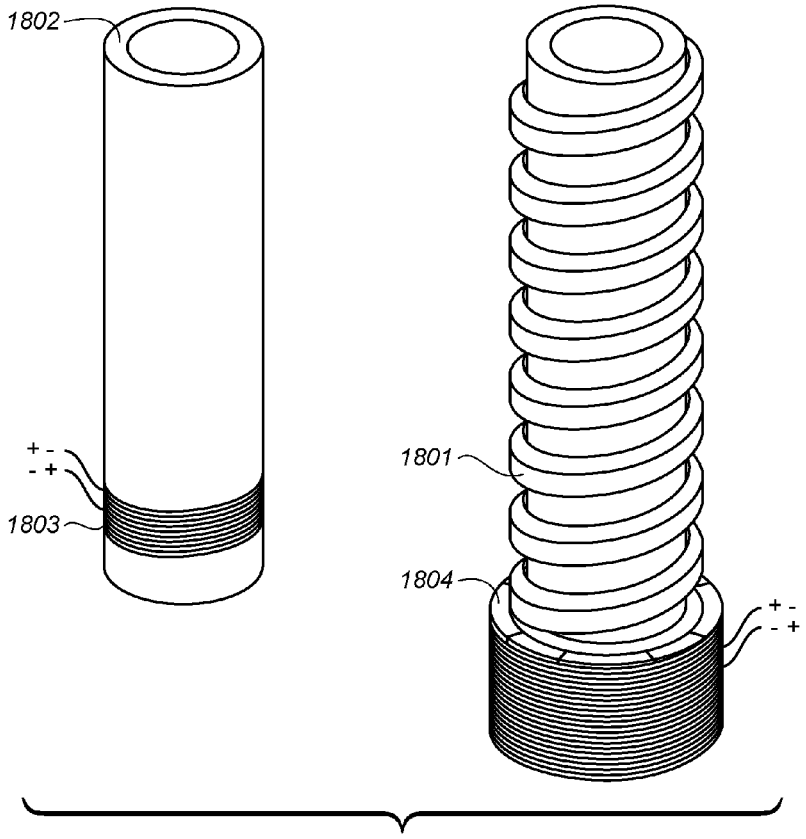
FIG. 18 shows a hybrid power source and steering mechanism.

FIG. 18 describes another embodiment where the helical coil 1801 becomes a generator of power to be used to run an electric motor by installing a coil 1803 on the outer hull tube 1802 to interact with magnets displaced on the helical coil and magnets 1804 are displaced on the bottom of the helical coil to interact with a coil on the outer hull tube turning helical coil allowing for up and down motion.

Figure 19:
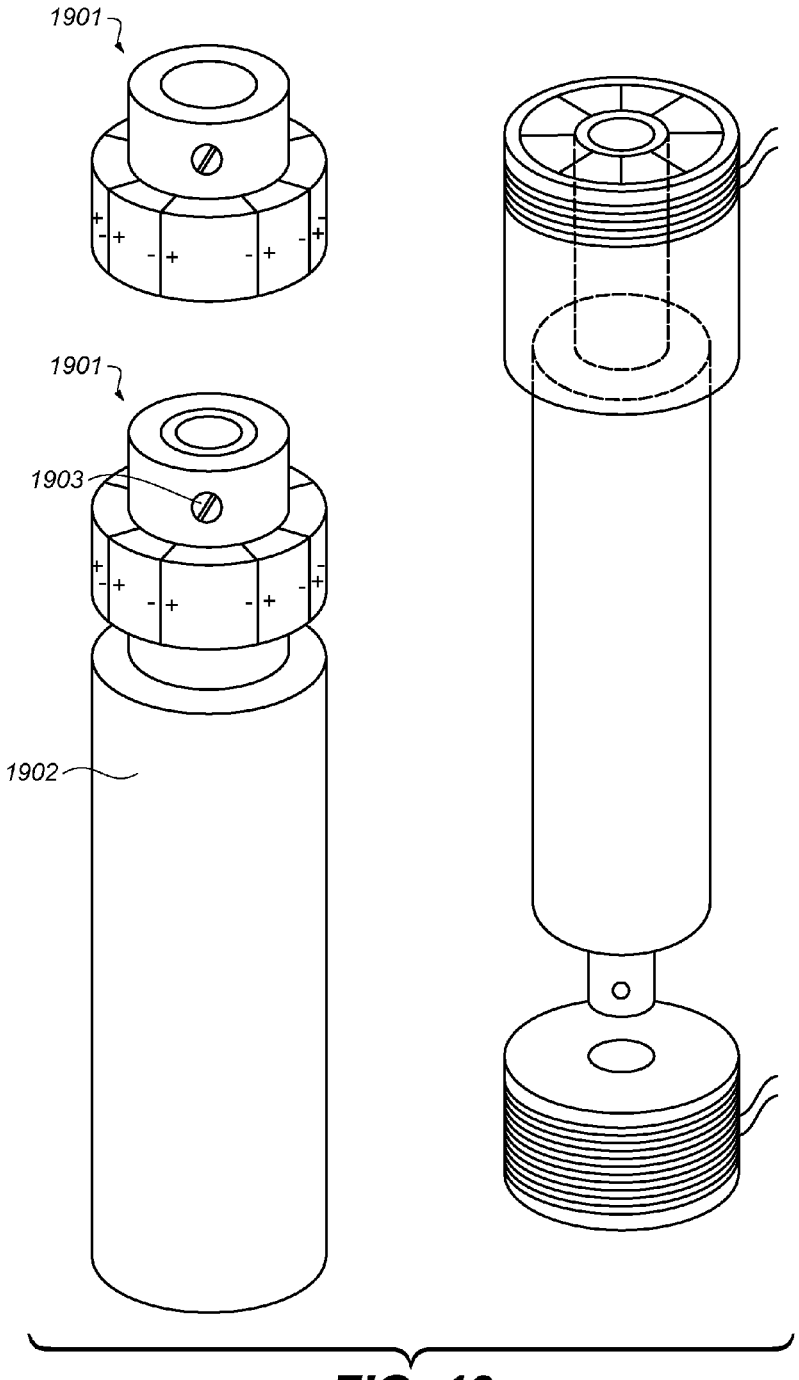
FIG. 19 shows a coil and cap assembly that centers the coil assembly.

FIG. 19 describes an embodiment where a coil and cap style assembly that can be attached in such a way as to secure it to the boat. It can be centered or otherwise aligned to create the field and also for motor motion to provide steering. For instance a magnetic collar 1901 can be attached on top of the steering tube 1902. This piece can be installed in place of the rear pulley described above. A screw lug 1903 can be used to secure the collar to the tube. Alternately a coil can be installed on steering cap to interact with steering tube. The coil can be mounted on a structure that includes a hole for electric wires to pass through to the electric motor or the coil(s). A member extending from these assemblies can attach to the hull.

Advantages of this embodiment include providing electrically controlled steering by installing it on steering tube and having it provide its own motive power. (i.e., no external motor in the passenger area of the boat is required since the motor is built in or onto the tube).

Figure 20:
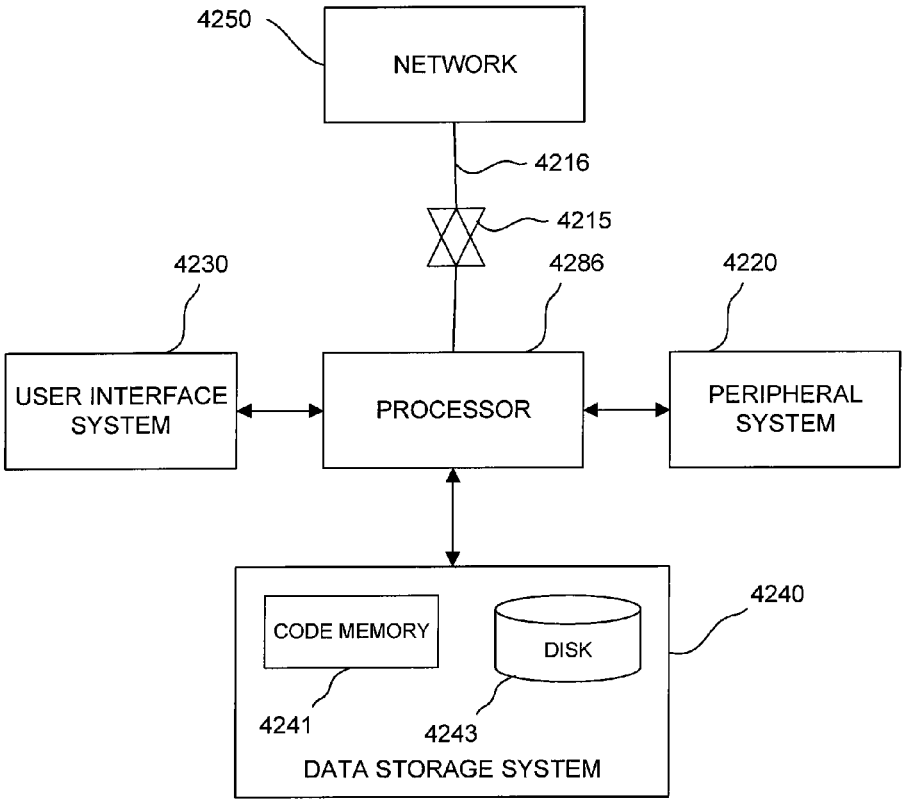
FIG. 20 shows the electronic control mechanism that can be employed to control various functions and embodiments of the invention.

FIG. 20 includes a high-level diagram showing the components of an exemplary data-processing system for analyzing data and performing other analyses described herein, and related components. The system includes a processor 4286, a peripheral system 4220, a user interface system 4230, and a data storage system 4240. The peripheral system 4220, the user interface system 4230 and the data storage system 4240 are communicatively connected to the processor 4286. Processor 4286 can be communicatively connected to network 4250 (shown in phantom), e.g., the Internet or an X.425 network, as discussed below. Controllers for the motor coils shown in the Papers, e.g., multi-phase AC motor drivers or brushless DC motor controllers, or controllers for motors driving gears or pulleys described herein, can each include one or more of systems 4286, 4220, 4230, 4240, and can each connect to one or more network(s) 4250. Processor 4286, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 4286 can implement processes of various aspects described herein. For example, processor 4286 can control current sources, voltage sources, motors, electric, hydraulic, or pneumatic switches, or other devices to cause retraction or steering as described herein. Processor 4286 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. Processor 4286 can include Harvard-architecture components, modified-Harvard-architecture components, or Von-Neumann-architecture components.

The phrase "communicatively connected" includes any type of connection, wired or wireless, for communicating data between devices or processors. These devices or processors can be located in physical proximity or not. For example, subsystems such as peripheral system 4220, user interface system 4230, and data storage system 4240 are shown separately from the data processing system 4286 but can be stored completely or partially within the data processing system 4286.

The peripheral system 4220 can include one or more devices configured to provide digital content records to the processor 4286. For example, the peripheral system 4220 can include digital still cameras, digital video cameras, cellular phones, or other data processors. The processor 4286, upon receipt of digital content records from a device in the peripheral system 4220, can store such digital content records in the data storage system 4240.

The user interface system 4230 can include a mouse, a keyboard, another computer (connected, e.g., via a network or a null-modem cable), or any device or combination of devices from which data is input to the processor 4286. The user interface system 4230 also can include a display device, a processor-accessible memory, or any device or combination of devices to which data is output by the processor 4286. The user interface system 4230 and the data storage system 4240 can share a processor-accessible memory.

In various aspects, processor 4286 includes or is connected to communication interface 4215 that is coupled via network link 4216 (shown in phantom) to network 4250. For example, communication interface 4215 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 4215 sends and receives electrical, electromagnetic or optical signals that carry digital or analog data streams representing various types of information across network link 4216 to network 4250. Network link 4216 can be connected to network 4250 via a switch, gateway, hub, router, or other networking device.

Processor 4286 can send messages and receive data, including program code, through network 4250, network link 4216 and communication interface 4215. For example, a server can store requested code for an application program (e.g., a JAVA applet) on a tangible non-volatile computer-readable storage medium to which it is connected. The server can retrieve the code from the medium and transmit it through network 4250 to communication interface 4215. The received code can be executed by processor 4286 as it is received, or stored in data storage system 4240 for later execution.

Data storage system 4240 can include or be communicatively connected with one or more processor-accessible memories configured to store information. The memories can be, e.g., within a chassis or as parts of a distributed system. The phrase "processor-accessible memory" is intended to include any data storage device to or from which processor 4286 can transfer data (using appropriate components of peripheral system 4220), whether volatile or nonvolatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), erasable programmable read-only memories (EPROM, EEPROM, or Flash), and random-access memories (RAMs). One of the processor-accessible memories in the data storage system 4240 can be a tangible non-transitory computer-readable storage medium, i.e., a non-transitory device or article of manufacture that participates in storing instructions that can be provided to processor 4286 for execution.

In an example, data storage system 4240 includes code memory 4241, e.g., a RAM, and disk 4243, e.g., a tangible computer-readable rotational storage device such as a hard drive. Computer program instructions are read into code memory 4241 from disk 4243. Processor 4286 then executes one or more sequences of the computer program instructions loaded into code memory 4241, as a result performing process steps described herein. In this way, processor 4286 carries out a computer implemented process. For example, steps of methods described herein, blocks of the flowchart illustrations or block diagrams herein, and combinations of those, can be implemented by computer program instructions. Code memory 4241 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 4286 (and possibly also other processors), to cause functions, acts, or operational steps of various aspects herein to be performed by the processor 4286 (or other processor). Computer program code for carrying out operations for various aspects described herein may be written in any combination of one or more programming language(s), and can be loaded from disk 4243 into code memory 4241 for execution. The program code may execute, e.g., entirely on processor 4286, partly on processor 4286 and partly on a remote computer connected to network 4250, or entirely on the remote computer.

The invention is inclusive of combinations of the aspects described herein. References to "a particular aspect" and the like refer to features that are present in at least one aspect of the invention. Separate references to "an aspect" (or "embodiment") or "particular aspects" or the like do not necessarily refer to the same aspect or aspects; however, such aspects are not mutually exclusive, unless so indicated or as are readily apparent to one of skill in the art. The use of singular or plural in referring to "method" or "methods" and the like is not limiting. The word "or" is used in this disclosure in a non-exclusive sense, unless otherwise explicitly noted.

The invention has been described in detail with particular reference to certain preferred aspects thereof, but it will be understood that variations, combinations, and modifications can be effected by a person of ordinary skill in the art within the spirit and scope of the invention.

What is claimed is:

1. A shallow draft watercraft, comprising:

a) a hull with gunnels;

b) a stern flotation compartment;

c) the hull having a modified stern hull contour carved out underneath the gunnels to admit a steering and propulsion system, the hull contour being defined by two contours extending from a top most stern point, each contour extending along a substantially S-shaped path about a centerline of the watercraft and in which an axial portion of the hull, including the stern flotation compartment, extends above the bottom point of the hull, the steering and propulsion system comprising:

a vertical cylindrical sleeve extending through the stern flotation compartment from the compartment's top down to the bottom of the modified stern hull contour and sealed to the compartment's top and sealed to the bottom of the modified stern hull contour;

a steering shaft having a means for propulsion affixed on the bottom of said shaft; and a screw gear assembly affixed to a side of said steering shaft;

an electrical motor that displaces a mechanical means to displace said steering shaft vertically wherein the modified stern hull contour and said stern mounted steering and propulsion system exclusively enables propulsion and steering for the watercraft.

2. The watercraft of claim 1, wherein the steering shaft comprises a gear train for turning said steering shaft.

3. The watercraft of claim 1, wherein the steering shaft comprises a sprocket and chain assembly for turning said steering shaft.

4. The watercraft of claim 1, further comprising a retraction assembly wherein the retraction assembly comprises a retraction arm and linkage system for retracting the vertical cylindrical sleeve and the electric motor.

5. The watercraft of claim 1, further comprising means for jet propulsion.

6. The watercraft of claim 1, further comprising a vane or fin attached to the bottom of the electric motor to stabilize travel and translate impacts into retraction force.

7. The watercraft of claim 6, wherein the modified stern hull contour incorporates a recess admitting the upper half of a propeller driven by the electric motor.

8. The watercraft of claim 7, wherein the propulsion and steering system are mounted turnably on a lateral pivot affixed in a vertical hull opening for altering a pitch attitude of said propulsion and steering system.

9. The watercraft of claim 1, further comprising induction coils mounted on the exterior of the vertical cylindrical sleeve and magnets mounted on the steering shaft.

10. The watercraft of claim 9, wherein said magnets are provided in a cap affixed to the top of said steering shaft.

11. A shallow draft watercraft having a steering and propulsion system disposed exclusively in the stern of the watercraft, said water craft comprising a) gunwales;

b) a stern flotation compartment;

c) a hull having a modified stern hull contour carved out underneath the gunwales to admit a vertical cylindrical sleeve of the steering and propulsion system, the hull contour being defined by two contours extending from a top most stern point, each contour extending along a substantially S-shaped path about a centerline of the watercraft and in which an axial portion of the hull, including the stern flotation compartment, extends above the bottom point of the hull, the steering and propulsion system comprising:

the vertical cylindrical sleeve extending through the stern flotation compartment from the compartment's top down to the bottom of the modified stern hull contour and sealed to the compartment's top and sealed to the bottom of the modified stern hull contour;

a slotted cylindrical steering tube having one or more vertical slots open through its sides;

a steering assembly affixed to the slotted cylindrical steering tube;

a vertical mounting tube fitting closely within the slotted cylindrical steering tube;

one or more studs anchored to an exterior of the vertical mounting tube, each protruding through one of the one or more vertical slots in the slotted cylindrical steering tube;

a guide tube fitting closely within the vertical mounting tube;

an electric motor attached to a bottom end of the vertical mounting tube;

an electrical power cable connected to the electric motor;

a retraction assembly affixed to the electric motor; and an upper bearing and a lower bearing both affixed to the vertical cylindrical sleeve and the slotted cylindrical steering tube so as to allow free rotation of the cylindrical steering tube around its longitudinal axis.

12. The watercraft of claim 11, wherein the steering assembly comprises a gear train for turning the slotted cylindrical steering tube.

13. The watercraft of claim 11, wherein the steering assembly comprises a pulley system for turning the slotted cylindrical steering tube.

14. The watercraft of claim 11, wherein the retraction assembly comprises a cable and pulley system for retracting the vertical mounting tube and the attached electric motor.

15. The watercraft of claim 11, wherein the retraction assembly comprises a retraction arm and linkage system for retracting the vertical mounting tube and the attached electric motor.

16. The watercraft of claim 11, further comprising a vane or fin attached to the bottom of the electric motor to stabilize travel and translate impacts into retraction force.

17. The watercraft of claim 11, wherein the modified stern hull contour incorporates a recess admitting an upper half of a propeller driven by the electric motor.

18. The watercraft of claim 11, wherein the propulsion system and steering assembly are mounted turnably on a lateral pivot affixed in a vertical hull opening for altering a pitch attitude of said propulsion system and steering assembly.

19. A method for configuring a shallow draft watercraft with a stern mounted steering and propulsion system, said watercraft having a hull with gunnels and a stern flotation compartment, the method comprising:

modifying the stern with a hull contour carved out underneath the gunnels, the contour being shaped to admit a vertical cylindrical sleeve and defined by two contours extending from a top most stern point, each contour extending along a substantially S-shaped path about a centerline of the watercraft and in which an axial portion of the hull, including the stern flotation compartment, extends above the bottom point of the hull;

extending a vertical cylindrical sleeve through the stern flotation compartment from the compartment's top down to the bottom of the modified stern hull contour and sealing the cylindrical sleeve to the compartment's top and the bottom of the modified stern hull contour, respectively;

providing a steering shaft having a means for propulsion affixed at the bottom of the steering shaft;

providing a screw gear assembly affixed to a side of the steering shaft;

providing an electrical motor that displaces a mechanical means to selectively displace the steering shaft vertically wherein the modified stern hull contour includes a recess admitting the upper half of a propeller used as the means for propulsion to be driven by the electrical motor, and wherein the stern mounted steering and propulsion system is configured to exclusively enables propulsion and steering for the shallow draft watercraft.

* * * * *